United States Patent [19]

Römhild

[11] 4,288,045

[45] Sep. 8, 1981

[54] DEVICE FOR CONTROLLING THE TENSION OF A WEB

[75] Inventor: Werner Römhild, Landau, Fed. Rep. of Germany

[73] Assignee: Tidland GmbH, Ahaus, Fed. Rep. of Germany

[21] Appl. No.: 105,736

[22] Filed: Dec. 20, 1979

[30] Foreign Application Priority Data

Dec. 22, 1978 [DE] Fed. Rep. of Germany ..... 2855591
Dec. 22, 1978 [DE] Fed. Rep. of Germany ..... 2855592

[51] Int. Cl.[3] ..... B65H 59/00
[52] U.S. Cl. ..... 242/75.53
[58] Field of Search ..... 242/75.53, 75.5, 75.51, 242/75.52; 226/38

[56] References Cited

U.S. PATENT DOCUMENTS

| | | | |
|---|---|---|---|
| 2,677,080 | 4/1954 | Halter | 242/75.53 X |
| 3,101,915 | 8/1963 | Aaron | 226/38 X |
| 3,784,123 | 1/1974 | Lewis | 242/75.53 |
| 3,974,948 | 8/1976 | Kroppenstedt | 242/75.53 X |

*Primary Examiner*—Edward J. McCarthy

*Attorney, Agent, or Firm*—Cooper, Dunham, Clark, Griffin & Moran

[57] ABSTRACT

The invention describes a device for controlling the tension of a web discharged from a delivery spool including a compensating roller around which the web is guided to which a tiltingly supported lever is connected the deflection of which influences a pneumatic valve, which provides, in a compressed-air line system including a reduction valve, for the pneumatic pressure of a brake cylinder of a pneumatic brake of a machine processing the web, wherein the lever 4 is engaged by a tension spring with adjustable stroke and the lever is tiltable between two end switches 10, 11, which actuate valves including series-connected reduction valves 14, 15 inserted into one pneumatic line 12, 13 each, both being connected to a compressed-air tank 19 which actuates the brake cylinder 22, the valve actuated in case of a decrease of the tension of the web 1 being inserted into the line under pressure 12 and when actuated by the lever 4 connecting the compressed-air tank 19 to the compressed-air source 15*a,* and the valve actuated in case of an increase of the tension of the web 1 being inserted into a line 13 leading to the atmosphere and when actuated connecting the compressed-air tank 19 to the atmosphere.

4 Claims, 1 Drawing Figure

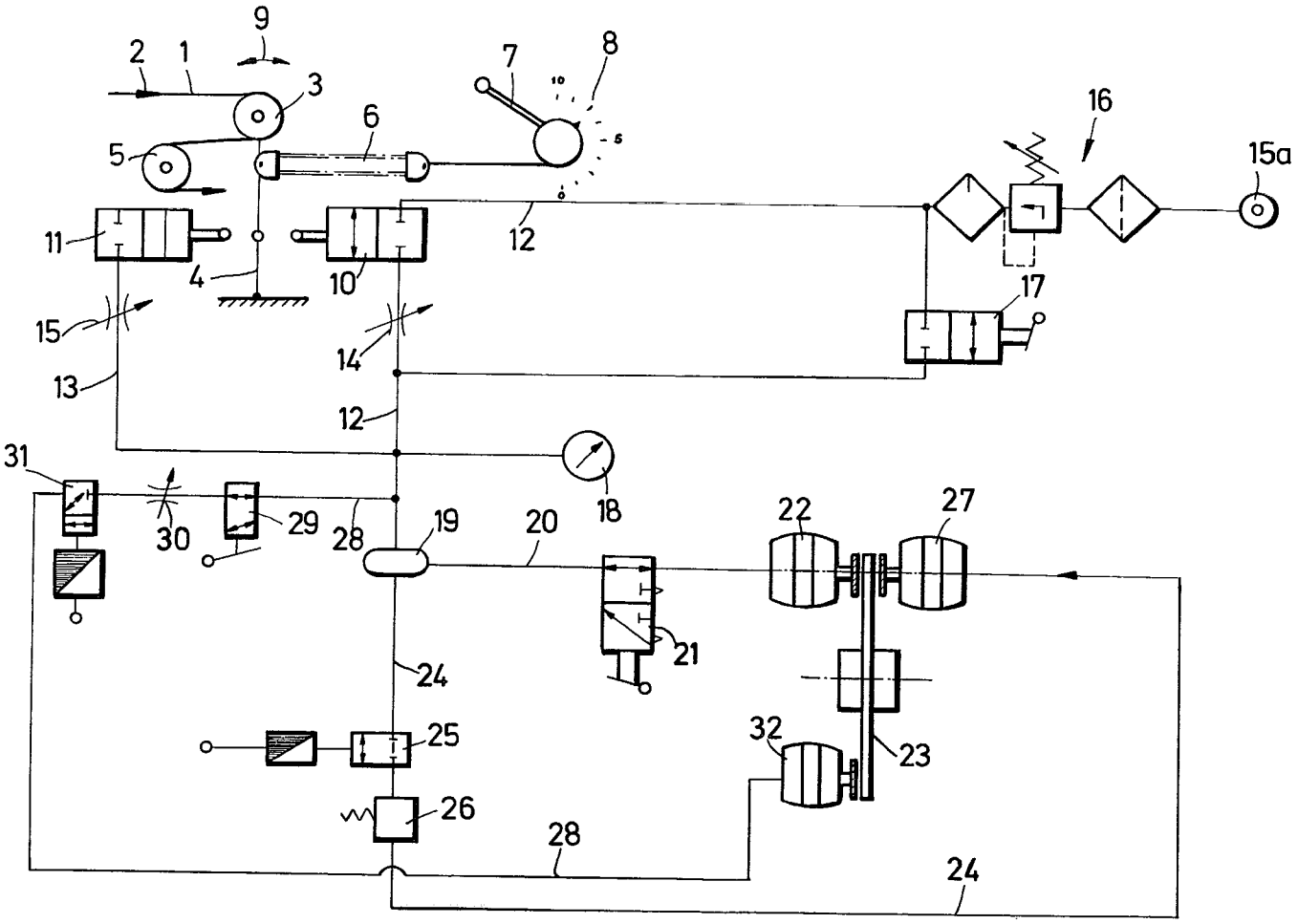
15a
16
17
27
23
24
22
32
21
8
18
28
7
12
20
19
24
25
26
6
10
14
12
28
3
29
9
4
1
30
2
5
11
15
13
31

DEVICE FOR CONTROLLING THE TENSION OF A WEB

The invention relates to a device for controlling the tension of a web discharged from a delivery spool including a compensating roller around which the web is guided to which a tiltingly supported lever is connected the deflection of which influences a pneumatic valve, which provides, in a compressed-air line system including a reduction valve, for the pneumatic pressure of a brake cylinder of a pneumatic brake of a machine processing the web.

Such a device has been described in German Auslegeschrift No. 1,574,393. According to this publication, the reduction valve and the valve are inserted, in parallel relative to each other, into the lines connected to the compressed-air source. Depending on the position of the tiltable lever, the valve opens or closes, respectively. If the valve is closed, the pressure actuates, via the reduction valve, the brake cylinder in the sense of an increase of the braking force while the compressed air escapes via a branch line guided to the valve into the atmosphere. If the valve is open, this branch line is closed, and the compressed air escapes through the valve so that the brake cylinder is actuated in the sense of a decrease of the braking force.

Practice has shown that in spite of the provision of the reduction valve, provided in parallel relative to the valve in the pressure line, the brake is either open or closed. This prior art device does therefore not permit a fine regulation. Such a fine regulation is desirable, particularly because the mass to be braked depends substantially on the quantity of the web on the delivery spool. In the prior art device, there exists the danger that either the brake snaps in too strongly so that too-high tensions might occur in the running web or it is too weak and does not sufficiently control the tension of the running web.

German Auslegeschrift No. 1,103,634 describes an electrically actuated device for controlling the quantity of a web discharged from a spool. In this instance, too, the web is guided around a compensating roller connected with a tiltingly supported lever the deflection of which actuates, via an electric control circuit, the drive motor for the delivery spool. In this case, the control refers to a constant quantity of the material per time unit rather than a constant tension of the web of material. The lever is engaged by a tension spring, if desired with an adjustable tension, which tries to draw the lever into its zero position.

Starting from a device of the kind mentioned in the beginning, it is the aim of the invention to so provide the former that a delicately sensitive regulation is obtained, which may at any moment be applied to the moving mass of the machine to be braked particularly to the length of the web still on the delivery spool. If desired, a delicately adjusted emergency halt, and if desired also a normal halt of the machine is moreover to be aimed at as well.

In order to solve this problem, the invention is characterized in that the lever is engaged by a tension spring with adjustable stroke and the lever is tiltable between two end switches, which actuate valves including series-connected reduction valves inserted into one pneumatic line each, both being connected to a compressed-air tank, which operates the brake cylinder, the valve actuated in case of a decrease of the tension of the web being inserted into the line under pressure and when actuated by the lever connecting the compressed air tank to the compressed air source, and the valve actuated in case of an increase of the tension of the web being inserted into a line leading to the atmosphere and when actuated connecting the compressed-air tank to the atmosphere.

In view of the measures described, the compressed-air tank has constantly available a pressure, which corresponds to the momentary tension of the web and thus also to the mass momentarily to be braked. By the two reduction valves, the corresponding pressure variations occurring in the regulation process are retarded so that the regulation is smooth rather than suddenly. The stroke of the tension spring acting on the lever being adjustable, the tension of the web is constantly reproducible and also adjustable.

Because of the properties mentioned of the pressure in the compressed-air tank, the former is preferably employed to additionally operate a second brake cylinder for the emergency halt.

For the same reason, an additional third brake cylinder for normal halt may also be actuated by the compressed-air tank.

The second brake cylinder as mentioned may preferably be followed by a pressure transmitter in order to constantly safeguard the necessary pressure for an emergency halt on the second brake cylinder. The pressure transmitter adds, for instance a pressure of 2 bars to the pressure in the compressed-air tank.

The invention will now be described in more detail based on an exemplified embodiment from which further important features may be taken. The FIGURE shows a circuit diagram of the major elements of the novel device.

A web 1 runs from a delivery spool, not shown in the drawing, in the direction of arrow 2 through a machine processing the web. The web is guided around a compensating roller 3 rotatably secured to a tiltably supported lever 4. Behind the compensating roller 3, a further roller 5 is so arranged that the web, ahead of and after the compensating roller, is essentially in paralell thereto independently of the position of lever 4.

Lever 4 is engaged by a tension spring 6 the stroke of which is adjustable via an adjustment lever 7 including a scale 8.

Independent from the tension of web 1, lever 4 is tilted in the direction of the double arrow 9. In the course of this tilting movement, it contacts end switches 10 or 11, respectively, provided on both sides of the lever and inserted into a line 12 or 13, respectively. A reduction valve 14 is provided in series relative to end switch 10 and a reduction valve 15 is provided in series relative to end switch 11.

A main contact 15*a* of pressure line 12 is connected, via a common service unit 16 comprising a pressure reducing valve regulator including a water separator, to pressure line 12. In parallel relative to valve 10, a manually actuated ventilating valve 17 is provided. Behind reduction valve 14, line 13 enters into pressure line 12. A manometer 18 gauges the pneumatic pressure available.

Pressure line 12 is furtheron guided to a compressed-air tank 19, which is connected, via a further pressure line 20 and a manually operable ventilating valve 21, to a first brake cylinder 22 of a pneumatic brake. The brake cylinder actuates a friction disc 23 which rotates together with the delivery spool for the web and is solidly connected therewith.

The device described so far operates as follows. If the tension of the web is for instance decreased, lever 4 is tilted to the right by tension spring 6 so that end switch 10 shifts its valve also to the right. This causes the pressure to expand from main contact 15*a* via line 12 to compressed-air tank 19 as a soft pressure increase rather than as a sudden thrust. In the compressed-air tank 19, there appears, after some time retardation, via reduction valve 14, a pressure of for instance 6 bars, which actuates brake cylinder 22 correspondingly so that the web is correspondingly braked. This increases the tension of the web and the lever 4 returns into the middle position as shown in the drawing.

If the tension of the web 1 is increased, lever 4 is tilted to the left and actuates, by its valve, end switch 11. The pressure adjusted in compressed-air tank 19 escapes now via valve 11 into the atmosphere so that the pressure in the compressed air tank and hence also the pressure on the brake cylinder 22 is correspondingly decreased. This too occurs in a timely retardation via reduction valve 15. The braking action declines until the tension of web 1 has again obtained the nominal value as set by lever 7. It should be mentioned that prior thereto valve 10 had taken the position again as shown in the drawing so that the compressed-air tank 19 was no longer connected to the main contact 15*a*.

The pressure in the compressed-air tank corresponds to that pressure with which the brake cylinder has to be actuated in order to hold the tension of the web. Tests have shown that this pressure becomes the smaller the smaller the quantity of the web on the delivery spool.

This situation may also be employed to perform rapid and normal deceleration. For rapid deceleration, a pressure line 24 is connected via a magnetic valve 25 and an adjustable pressure transmitter 26 to a second brake cylinder 27. For rapid decelerating, magnetic valve 27 is actuated and the pressure in the compressed-air tank 19 is transferred to the second brake cylinder 27 which causes the emergency halt.

For normal deceleration, a further pressure line 28 may be connected via a manually operable ventilating valve 29, an adjustable reduction valve 30 and a magnetic valve 31 to a third brake cylinder 32 for normal halt. If normal halt is to be effected, magnetic valve 31 is actuated and the pressure in the compressed-air tank 19 is smoothed via reduction valve 30 and is delivered to brake cylinder 32 which stops the machine.

Reduction valves 14 and 15 may be adjusted as well.

Terms employed for elements on drawing

1—web
2—arrow
3—compensating roller
4—lever
5—roller
6—tension spring
7—adjustment lever
8—scale
9—double arrow
10—end switch
11—end switch
12—line
13—line
14—reduction valve
15—reduction valve
16—service unit comprising pressure reducing valve regulator and water separator
17—ventilating valve
18—manometer
19—compressed-air tank
20—pressure line
21—ventilating valve
22—brake cylinder
23—friction disc
24—pressure line
25—magnetic valve
26—adjustable pressure transmitter
27—brake cylinder
28—pressure line
29—ventilating valve
30—reduction valve
31—magnetic valve
32—brake cylinder
15*a*—main contact.

I claim:

1. Device for controlling the tension of a web discharged from a delivery spool including a compensating roller around which said web is guided to which a tiltingly supported lever is connected the deflection of which influences a pneumatic valve, which provides, in a compressed-air line system including a reduction valve, for the pneumatic pressure of a brake cylinder of a pneumatic brake of a machine processing said web, wherein said lever is engaged by a tension spring with adjustable stroke and said lever is tiltable between two end switches, which actuate valves including series-connected reduction valves inserted into one pneumatic line each, both being connected to a compressed-air tank, which actuates said brake cylinder, the valve actuated in case of a decrease of the tension of said web being inserted into the line under pressure and when actuated by said lever connecting said compressed-air tank to the compressed-air source, and the valve actuated in case of an increase of the tension of said web being inserted into a line leading to the atmosphere and when actuated connecting said compressed-air tank to the atmosphere.

2. Device according to claim 1, wherein said compressed-air tank actuates, via a magnetic valve, an additional second pneumatic brake cylinder for an emergency halt of the machine processing said web.

3. Device according to claim 2, wherein between said magnetic valve and said second brake cylinder a pressure transmitter is provided.

4. Device according to one of claims 1 through 3, wherein said compressed-air tank actuates, via a reduction valve and a valve, an additional pneumatic brake cylinder for halting the machine.

* * * * *